US005424137A

United States Patent [19]

Stagl

[11] Patent Number: 5,424,137

[45] Date of Patent: Jun. 13, 1995

[54] SPORTSBALL RISER WITH MEDALLION HOLDER

[75] Inventor: Peter M. Stagl, Morris Plains, N.J.

[73] Assignee: Avnet, Inc., Great Neck, N.Y.

[21] Appl. No.: 82,590

[22] Filed: Jun. 25, 1993

[51] Int. Cl.[6] ..... G09F 19/00

[52] U.S. Cl. ..... 428/542.4; D11/131; 248/127; 428/11

[58] Field of Search ..... 428/542.4, 7, 11; 248/127, 158; 40/306; D11/131

[56] References Cited

U.S. PATENT DOCUMENTS 4,139,664 2/1979 Wenrick ..... 428/31
4,454,204 6/1984 Posey ..... 428/542.4

*Primary Examiner*—Henry F. Epstein
*Attorney, Agent, or Firm*—Darby & Darby

[57] ABSTRACT

A sportsball and medallion holder comprises a first hemisphere and a second hemisphere of similar diameter, each hemisphere having a circular edge in abutment along a parting line to form a hollow sphere. A slot is formed in the sphere on the parting line and extends inwardly from an outer surface through the wall of the sphere. A medallion holder includes a mounting having an outer surface whereon a medallion is fastened, and a plate for engaging the sphere, the plate being connected transversely to the mounting by a first portion having a cross-section that fits in the slot. The sportsball and medallion holder are assembled with the hemispheres forming a sphere and the mounting means for a medallion located outside the sphere with the first portion being retained in the slot. Edges of the hemispheres fit congruently into notches in the plate.

3 Claims, 2 Drawing Sheets

SPORTSBALL RISER WITH MEDALLION HOLDER

BACKGROUND OF THE INVENTION

The present invention relates to trophy constructions, and more particularly to a trophy construction in which the riser includes a sportsball, for example, a baseball, softball, volleyball, and the like, and a holder for a medallion mounted in a substantially tangential position on the sportsball. The riser also generally includes a decorative extrusion that supports the sportsball and in turn is mounted on a pedestal that stands on a base. A figurine is frequently positioned atop the sportsball.

Inexpensive trophies are conventionally made of extruded and die-cast plastic parts. In such a construction, the sportsball is usually a pair of hemispherical plastic shells that are joined together at a horizontal parting line to form a sphere. That is, the hemispheres are stacked one above the other to form the spherical "ball". The material is metalized plastic so that the appearance of the sportsball can be of gold or silver. A through-bolt extends from the .figurine, through the sportsball riser, pedestal and base, and a nut applied to the threaded end of the bolt, when tightened, rigidizes the trophy.

By detailing the external surfaces of the molded plastic parts, metalizing to give the appearance of a precious or semiprecious metal, and by weighting the base, the appearance and feel of a quality metal product is provided for the less expensive plastic trophy.

Frequently, a sports medallion, for example, a 1 inch disk, which may also be molded of plastic, is mounted to the sportsball, generally, by providing a circular depression or inset in the ball's surface. The medallion is seated in this depression, for example, using an adhesive.

This arrangement for including and displaying a medallion has several disadvantages. Setting the medallion into a recess makes it less conspicuous on the overall trophy. Also, the recess has a fixed diameter and provides a suitable appearance only for those medallions of substantially equal diameter.

What is needed is a medallion holder that may be mounted on a plastic sportsball and can accommodate different medallion sizes and configurations without requiring modification to a basic sportsball construction.

SUMMARY OF THE INVENTION

An object of the present invention is to provide an improved plastic sportsball riser and a medallion holder suitable for mounting different sizes and shapes of medallions without any modifications to the sportsball for each variation.

Another object of the invention is to provide an improved plastic sportsball riser and medallion holder that permits a pair of identical hemispheres to form the sportsball and mount medallion holder.

Still another object of the present invention is to provide an improved sportsball riser and medallion holder that join together without visible gaps and provide a rigid, non-wobbling connection.

In accordance with the invention, a sportsball and medallion holder comprises a first hemisphere and a second hemisphere of similar diameter, each hemisphere having a circular edge in abutment along a parting line to form a hollow sphere. A slot is formed in the sphere on the parting line and extends inwardly from an outer surface through the wall of the sphere. A medallion holder includes a mounting having an outer surface whereon a medallion is fastened, and a plate for engaging the sphere, the plate being connected transversely to the mounting by a first portion having a cross-section that fits in the slot. The sportsball and medallion holder are assembled with the hemispheres forming a sphere and the mounting means for a medallion located outside the sphere with the first portion being retained in the slot. Edges of the hemispheres fit congruently into notches in the plate.

The above-mentioned and other features of the present invention and the manner of attaining the same will become more apparent, and the invention itself will be best understood from the following detailed description of a preferred embodiment of the invention when read with reference to the accompanying drawings.

DETAILED DESCRIPTION OF A PREFERRED EMBODIMENT

Figure 1:
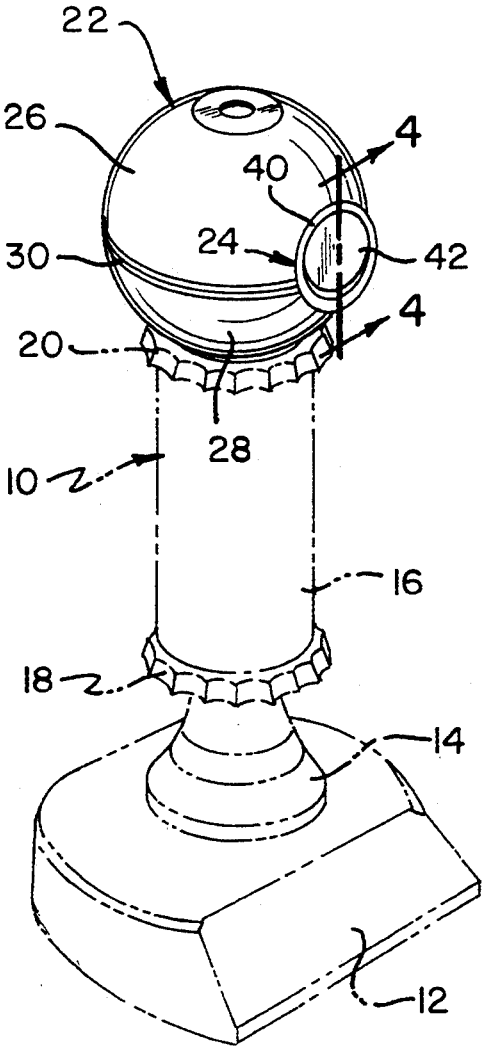
FIG. 1 is a partial perspective view of a trophy with a sportsball riser and medallion holder in accordance with the present invention.

A trophy 10, in accordance with the invention, includes a base 12 for supporting the trophy on a surface such as a table or shelf, a riser 14 placed on the base 12, a decorative extrusion 16 supported on the riser 14 and mounted between two lids 18,20, and a sportsball 22 atop the lid 20. Generally, a figurine (not shown) is mounted on top of the sportsball 22 and the entire trophy is held together by a through-bolt (not shown) that is connected to the figurine at one end and passed through the vertical assemblage to the underside of the base 12, where a nut is attached to the through-bolt and tightened so as to rigidize the trophy 10, in a known manner.

All of these elements of the trophy 10 can be conventionally fabricated of plastic which is metalized with gold or silver tones. Other colors are also incorporated, for example, in the decorative extrusion 16. The base may be made to simulate marble and is frequently filled with a fluid material that hardens into a cement-like structure thereby giving weight to the trophy 10.

Figure 2:
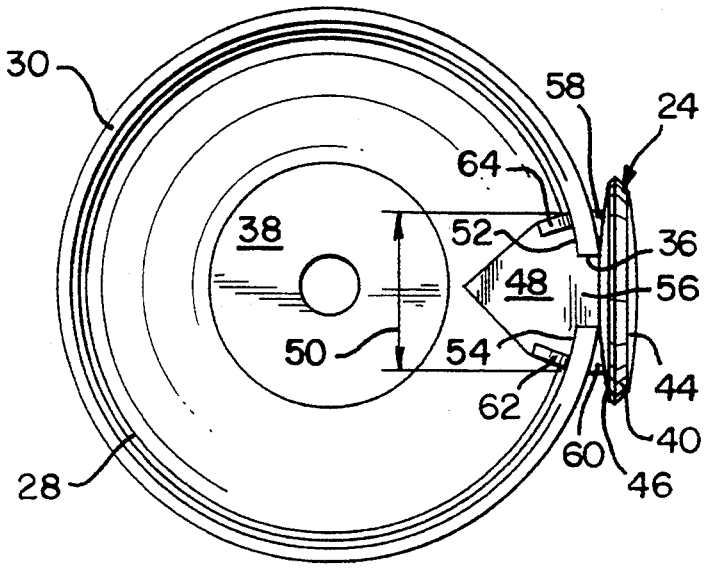
FIG. 2 is an elevational view of the concave interior of a hemisphere, and a medallion holder of FIG. 1.
Figure 4:
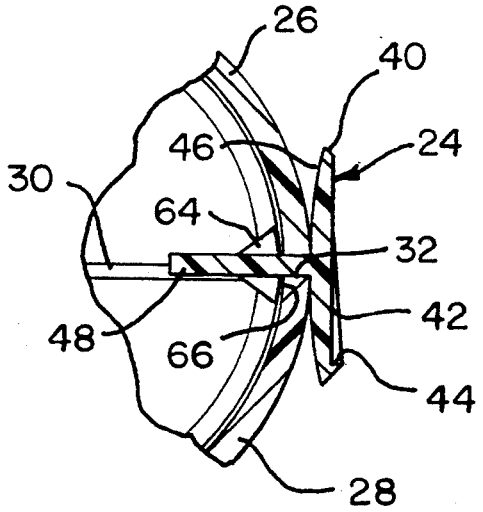
FIG. 4 is a partial sectional view of the sportsball and medallion holder taking along the line 4—4 of FIG. 1.
Figure 5:
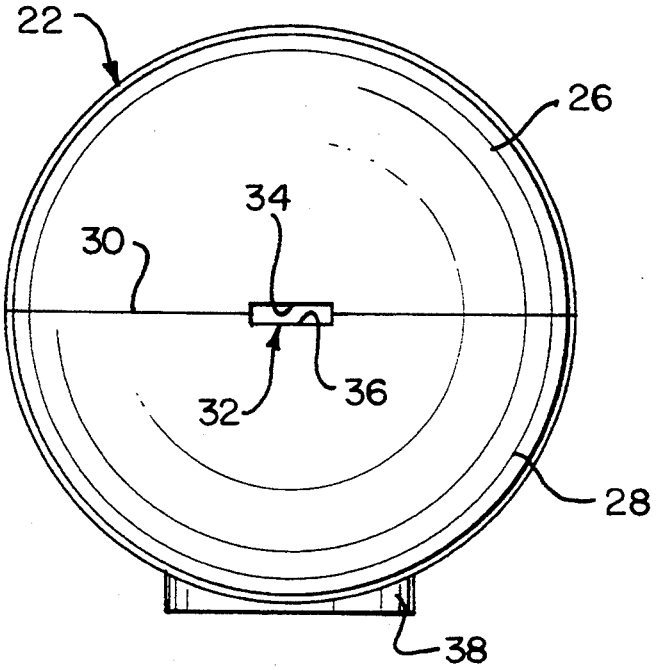
FIG. 5 is a front elevational view of the sportsball of FIG. 1, without the medallion holder in place.

The sportsball 22 is comprised of an upper hemisphere 26 and a lower hemisphere 28. As indicated in FIGS. 2, 4 and 5, the hemispheres are hollow and joined together along a parting line 30 to form the ball 22. A slot 32 in the sportsball 22 along the parting line 30 is formed by juxtaposition of a notch 34 along the circular edge of the hemisphere 26 and notch 36 along the circular edge of the hemisphere 28.

The edge constructions of the hemispheres 26,28 are not considered to be a novel portion of the present invention and accordingly are not discussed in detail herein. Needless to say, interlocking arrangements are made such that a sturdy joint is provided along the parting line 30, and the hemispheres 26,28 are joined together with the notches 34,36 in registry to produce the slot 32. The configuration of the circular edge of a hemisphere can be made so that two identical hemispheres 26, for example, can be placed circular edge to circular edge to produce a sportsball 22. On the other hand, as illustrated, the lower hemisphere 28 includes a footing or boss 38 that distinguishes the hemisphere 28 from the hemisphere 26.

As described hereinafter, the medallion holder 24 is constrained in the slot 32. The medallion holder 24 includes a generally circular disk 40 having a planar front face 42 for holding a medallion (not shown) thereon. A semi-circular lip 44 of increasing height surrounds the lower half of the front face 42 to provide an aligning cradle for a medallion that is to be attached to the disk 40, and also provides an attractive appearance. The back face 46 of the disk 40 is generally convex, although there is no criticality in this shape.

A flat plate 48 extends from the back face 46 of the disk 40. The thickness of the plate 48 corresponds to the thickness of the slot 32 as defined by the two notches 34, 36. The width 50 of the plate is larger than the width of the slot 32 defined by the notches 34,36, and arcuate notches 52,54 extend toward each other from opposite sides of the plate 48. The neck 56 of the plate 48 is dimensioned for a snug fit in the notch 32.

Notches 52,54 in the plate 48 have the same arcs on both arcuate sides of the notches as the curvature of the edges of the hemispheres. Therefore, not only does the neck 56 fit snugly in the slot 32 but also the ends of the hemisphere edges, adjacent to the slot 32, fit snugly in the notches 52,54 of the plate. In this way, the plate 48 makes line contact with both the inside and outside surfaces of both hemispheres 26,28, as illustrated in FIG. 2.

Additionally, the plate 48, with its notches 52,54, has fillets 58,60 that are integral with the back face 46 of the disk 40 and thereby lend rigidity to the disk 40 of the medallion holder 24.

Figure 3:
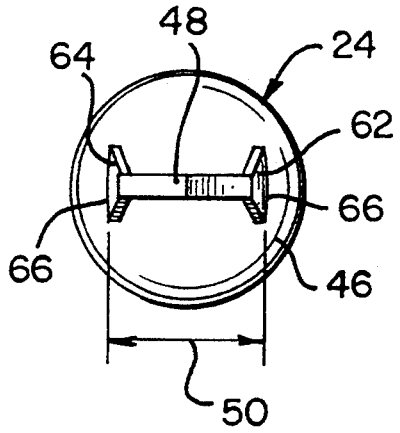
FIG. 3 is a back elevational view of a medallion holder of FIG. 1.

The plate 48 tapers to a point as illustrated in FIG. 2. However, there is no critically in this contour. A pair of generally triangular wings 62,64 are located on both sides of the plate 48. These wings 62,64 are adjacent to the notches 52,54 and extend on both sides of the plate 48 as illustrated in FIGS. 3, 4. When the medallion holder 24 is incorporated with the sportsball 22, arcuate edges 66 of the wings 62,64 are in line contact with the inner curvature of the hemispheres on both sides of the parting line 30. Thus, at the slot 32, the notches 52,54 are curved to accommodate the hemisphere edges and to provide constraint in the plane of the plate 48, while at the same time the wings 62,64 are in contact with the inner surfaces of the hemispheres to provide constraint perpendicularly to the plate 48. Thereby, a solid connection is provided between the hemispheres 26,28 and the medallion holder 24.

The wings, 62, although illustrated as generally triangular in shape are not so limited so long as the arcuate edges 66 of the wings provide line contact with the inner surfaces of the hemispheres.

During assembly, the medallion holder 24 is placed in a notch 34,36 with the neck 56 of the plate 48 fitting into the notch. Then, the other hemisphere is put in place to close the sportsball 22 with the medallion holder 24 firmly positioned. Completion of the trophy 10 using the through-bolt (not shown) as described above, assures that the medallion holder remains in place.

This same medallion holder can be used in any basically hollow sportsball that is made into portions that provide notches in registry so as to provide a slot corresponding to the slot 32 illustrated herein. The sportsballs can be molded with external markings to represent a baseball, basketball, volleyball, soccerball, and the like. Depending upon the authenticity of the markings, it may be necessary to have two hemispheres, as illustrated, that are slightly different from each other, or a pair of identical hemispheres may be used to form a single sportsball.

The sportsball need not be spherical, as illustrated. The sportsball can have half-shells which when put together provide the shape of a football. Any other shape can be provided. A medallion holder basically can be used wherever two hollow elements meet leaving a slot for positioning the medallion holder therein. The curvatures on the notches 52,54 and on the surfaces 66 of the wings 62,64, will, of course, correspond to the hollow object to which the medallion holder is applied.

Also, the "disk" 40 need not be round. It can be oval shaped, rectangularly shaped, and can in fact, be any size and shape that is desired.

Additionally, in an alternative embodiment in accordance with the invention, the planar front face 42 need not be perpendicular to the plate 48 as illustrated (FIG. 4) but may be tilted at another angle, preferably slightly upward so as to present a medallion that is attached to the medallion holder at a more favorable angle for viewing.

The shape of the slot 32 assures that the medallion holder 24 is not rotatable about the neck 56. Also, a non-round cross-section for the slot 32 helps to assure proper alignment of the medallion holder 24 in relation to the sportsball 22. A symmetrical relationship of the notches 34,36 relative to the parting line 30 is desirable in selecting a cross-section for the slot in that it can reduce the cost of molds for making the parts. However, any non-round cross-section for the slot is preferred so as to provide for simple orientation of the medallion holder relative to the sportsball.

Further, the portions of the medallion holder that are located within the hollow space need not be a flat plate. In an alternative embodiment, the inner surface of the sphere that surrounds the slot 32 may provide a chordal plane (not shown). In such an embodiment, the slots 52,54 would be shaped accordingly to provide a snug fit for the edges of the half-shells.

A feature that is common to all of the embodiments is substantial internal contact between the medallion holder and the inner surfaces of the sportsball, or any other hollow body that is constructed for attachment thereto of a medallion holder.

Additionally, an external boss (not shown) may surround the slot 32. In such an alternative embodiment, the fillets 58,60 are eliminated and the disk 40 may rest directly against the surface of the boss.

It will thus be seen that the objects set forth above, and those made apparent from the preceding description, are efficiently attained and, since certain changes may be made in the above constructions without departing from the spirit or the scope of the invention, it is intended that all matter contained in the above description, or shown in the accompanying drawings shall be interpreted as illustrative and not in a limiting sense.

What is claimed is:

1. A trophy comprising:

a first molded plastic body part having a first cavity therein;

a second molded plastic body part having a second cavity therein, each said body part having a peripheral edge, said edges being in abutment along a parting line to form a plastic body that is at least partially hollow, each of said body parts having a notch in its peripheral edge in registry with each other to thereby form a slot in said parting line between said body parts when they are joined; and a medallion holder having a mounting surface on which a medallion may be fastened and a mounting element extending through said slot, said mounting element including a portion within said plastic body that is wider than said slot and side notches defining a neck therebetween, said neck being of substantially the same cross-sectional size and shape as said slot, said notches being sized and shaped to receive the edge of each body part defining said slot in a tight fitting relationship.

2. A trophy according to claim 1, wherein said mounting element further includes two wings which are generally perpendicular to said mounting element, said wings each being shaped to engage the inner surface of at least one of said body parts to further stabilize the medallion holder.

3. A trophy according to claim 1, wherein said second molded plastic body part has a footing for positioning said plastic body atop a lid, said footing being spaced from said parting line.

* * * * *